United States Patent [19]

Boshold et al.

[11] 4,242,895

[45] Jan. 6, 1981

[54] METHOD AND APPARATUS FOR COOLING AND HANDLING EXTRUDED WORKPIECES

[75] Inventors: Raymond F. Boshold, Springfield; Francis J. Kent, Wallingford, both of Pa.

[73] Assignee: Wean United, Inc., Pittsburgh, Pa.

[21] Appl. No.: 943,252

[22] Filed: Sep. 15, 1978

[51] Int. Cl.[3] ..... B21C 29/00; B21C 35/00; C21D 1/62; C21D 1/667

[52] U.S. Cl. ..... 72/257; 72/253 R; 72/201; 266/114

[58] Field of Search ..... 72/253, 256, 257, 342, 72/201; 266/112-114; 134/64 R, 122 R, 199

[56] References Cited

U.S. PATENT DOCUMENTS

| | | | |
|---|---|---|---|
| 2,287,825 | 6/1942 | Postlewaite | 266/112 X |
| 2,688,332 | 9/1954 | Goodyear et al. | 134/64 R |
| 2,765,441 | 10/1956 | Gambrill | 207/1.2 |
| 3,230,753 | 1/1966 | Walker | 72/257 |
| 3,295,163 | 1/1967 | Bachus | 266/112 X |
| 3,514,986 | 6/1970 | Habscheidt et al. | 72/253 |
| 3,585,833 | 6/1971 | Carraher et al. | 72/257 |
| 3,659,830 | 5/1972 | Snyder et al. | 266/112 |
| 3,687,145 | 8/1972 | Schrader et al. | 266/113 |
| 3,921,964 | 11/1975 | Rossi et al. | 134/64 R X |
| 3,991,986 | 11/1976 | Ward et al. | 266/112 |
| 4,084,798 | 4/1978 | Dewsnap | 266/114 |

FOREIGN PATENT DOCUMENTS

| | | | |
|---|---|---|---|
| 85747 | 5/1971 | German Democratic Rep. | 72/253 |
| 112148 | 9/1962 | Pakistan | 72/257 |
| 574615 | 1/1946 | United Kingdom | 72/257 |

OTHER PUBLICATIONS

"Heat Treatment of Heavy Metals from Extrusion Temperature", by J. Broichausan, *Technical Report Hydraulic Presses*, Sep. 5-6, 1974.

*Primary Examiner*—Lowell A. Larson
*Attorney, Agent, or Firm*—Daniel Patch; Suzanne Kikel

[57] ABSTRACT

This disclosure relates in part to a hot extrusion press wherein the extrusion is cooled immediately after the extrusion operation by arranging a cooling tube including a cooling nozzle within the platen of the press and a second cooling nozzle between the platen and a water tank to which the extrusion is ultimately transferred for final cooling. The second cooling nozzle is employed to cool the extrusion and on the occasion of a cobbled extrusion, it is employed to drain the cooling tube and at the same time prevents water from flowing from the tank into the tube.

11 Claims, 8 Drawing Figures

METHOD AND APPARATUS FOR COOLING AND HANDLING EXTRUDED WORKPIECES

The present invention represents an improvement in past and present day methods and apparatuses employed for cooling a hot extrusion immediately after the extrusion operation and in handling the extrusion during the cooling operation. In the manufacture of tubing such as hot copper extrusion and certain other hot extruded materials it is highly desirable for metallurgical and other reasons to quickly cool the extrusion immediately after the extrusion operation.

One system for attempting this is what is referred to sometimes as an under water extrusion system. In this system the extrusion is passed into and through a batch of water immediately after it emerges the press.

In past production operation the extrusions were delivered to a water tank arranged at the exit side of the press through a cooling tube arranged between the press and tank. In this arrangement the extrusion had to pass from the die through the platen before it was subjected to any cooling. In certain applications this delay in applying cooling medium to the extrusion did not achieve the desired results either from a metallurgical standpoint or in minimizing oxidation.

Another limitation of existing under water cooling arrangements of the type above described has reference to the control of the water in the cooling tube and the cooling tank with reference to the removal of a cobbled extrusion from the cooling tube and the period of time when the press is inoperative. On the occasion of a cobble it is important for operational efficiency to gain access to the extrusion for its quick removal from the cooling tube. One of the considerations in accomplishing this is the removal of the water from the cooling tube and at the same time the prevention of water flowing from the cooling tank into the cooling tube, since the level of the water in the tank is usually maintained above the lower inside surface of the cooling tube.

As to the control of the water in and between the cooling tube and cooling tank, an additional problem in past arrangements has reference to the period of time when the press is inoperative at which times it is desirable to prevent the water from escaping into the cooling tube from the tank.

A still further limitation of past underwater extrusion cooling arrangements is the designs of the mechanism for receiving, supporting, and transferring the extrusion from the cooling tube to the cooling tank where at least some of the motivating elements of the mechanism were mounted in the tank and hence in the water.

The above disadvantages and limitations of present and past under water extrusion systems and others are overcome by the present invention.

More particularly the present invention has for its object provided a method and apparatus for controlling and handling hot extrusion in an under water system, in which the extrusions are subject to cooling immediately after leaving the die of the press and while in the platen of the press.

Another object of the present invention is to provide a cooling tube arranged between the press and a cooling tank for receiving a hot extrusion and having two cooperative nozzles arranged at its opposite ends, wherein one nozzle is located to subject the hot extrusion to rapid cooling immediately after leaving the die of the press and is capable of delivering cooling medium of sufficient high intensity and volume to effect rapid cooling of the extrusion, and the second nozzle is arranged and is capable of delivering cooling medium in a manner to effect further cooling of the extrusion and in addition to block water from flowing from the cooling tank into the cooling tube.

Another object of the present invention is to provide a cooling tube arranged between the press and a cooling tank for receiving a hot extrusion and having two cooperative nozzles arranged at its opposite ends and wherein during the experience of a cobbled extrusion, between the press and the cooling tank, the nozzle remote from the tank is rendered inoperative while the nozzle closest to the cooling tank is continued to be operated in a manner to both draw water from the cooling tube to thereby empty the tube and prevent water from the water tank running into the cooling tube.

Another object of the present invention provides for at least a section of the cooling tube to be constructed so that it can be quickly opened up for removal of a cobbled extrusion in the cooling tube once the water therein has been drawn off.

Another object of the present invention provides a selectable sealing arrangement for preventing water from flowing into the cooling tube from the cooling tank when the press is not in operation.

A still further object of the present invention is to provide a runout table mechanism for receiving, supporting and transferring an extrusion from the cooling tube to the cooling tank, wherein the mechanism, except for its extrusion contacting elements, is arranged totally outside the tank.

These objects, as well as other novel features and advantages of the present invention, will be better understood when the following description of a preferred embodiement thereof is read along with the accompanying drawings of which:

Figure 1A:
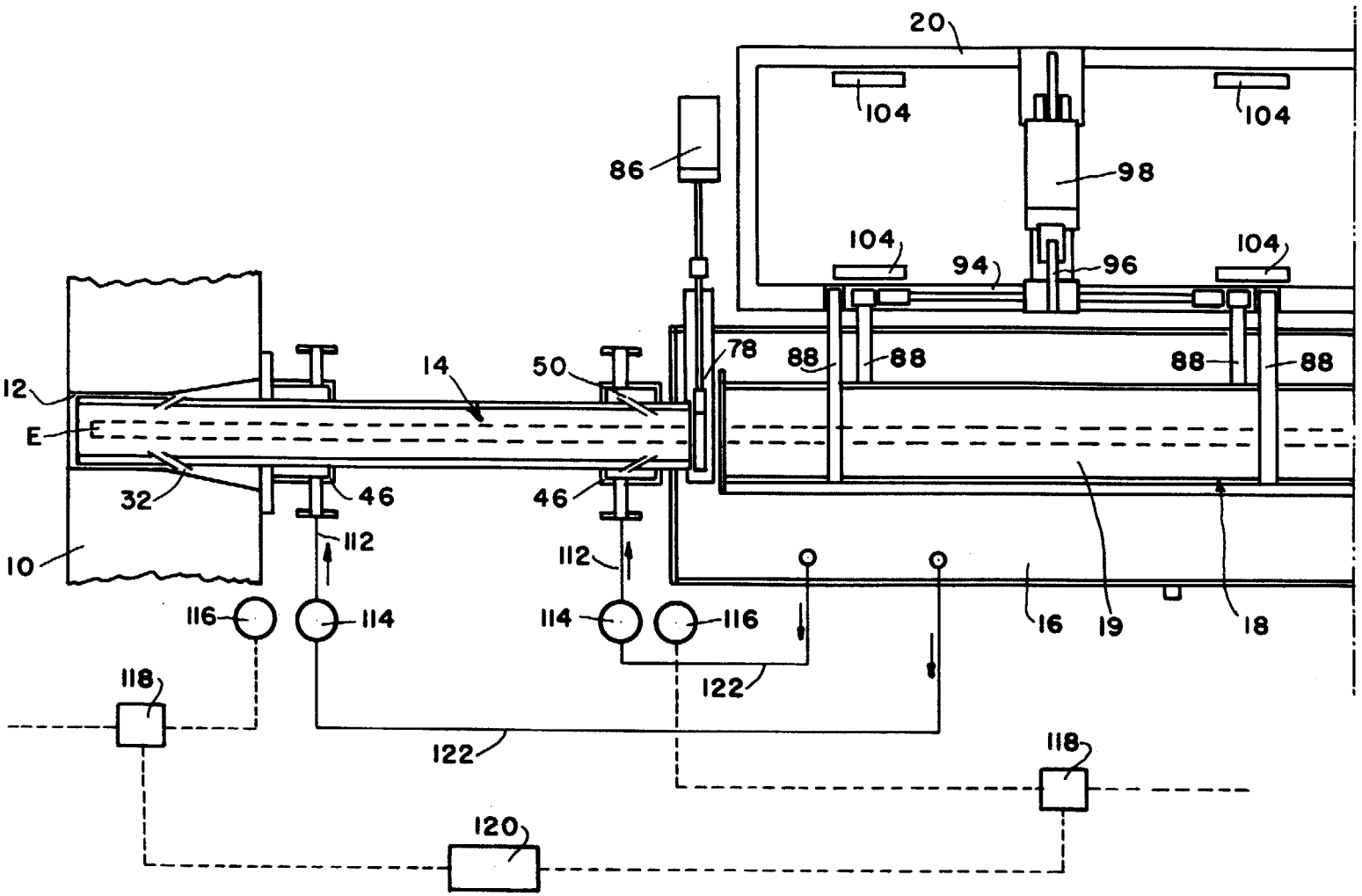
FIGS. 1A and 1B are continuous plan schematic views of an under water cooling system for a hot extrusion incorporating the features of the present invention and including a schematic representation of the cooling medium supply system for the cooling tube and cooling tank.
Figure 1B:
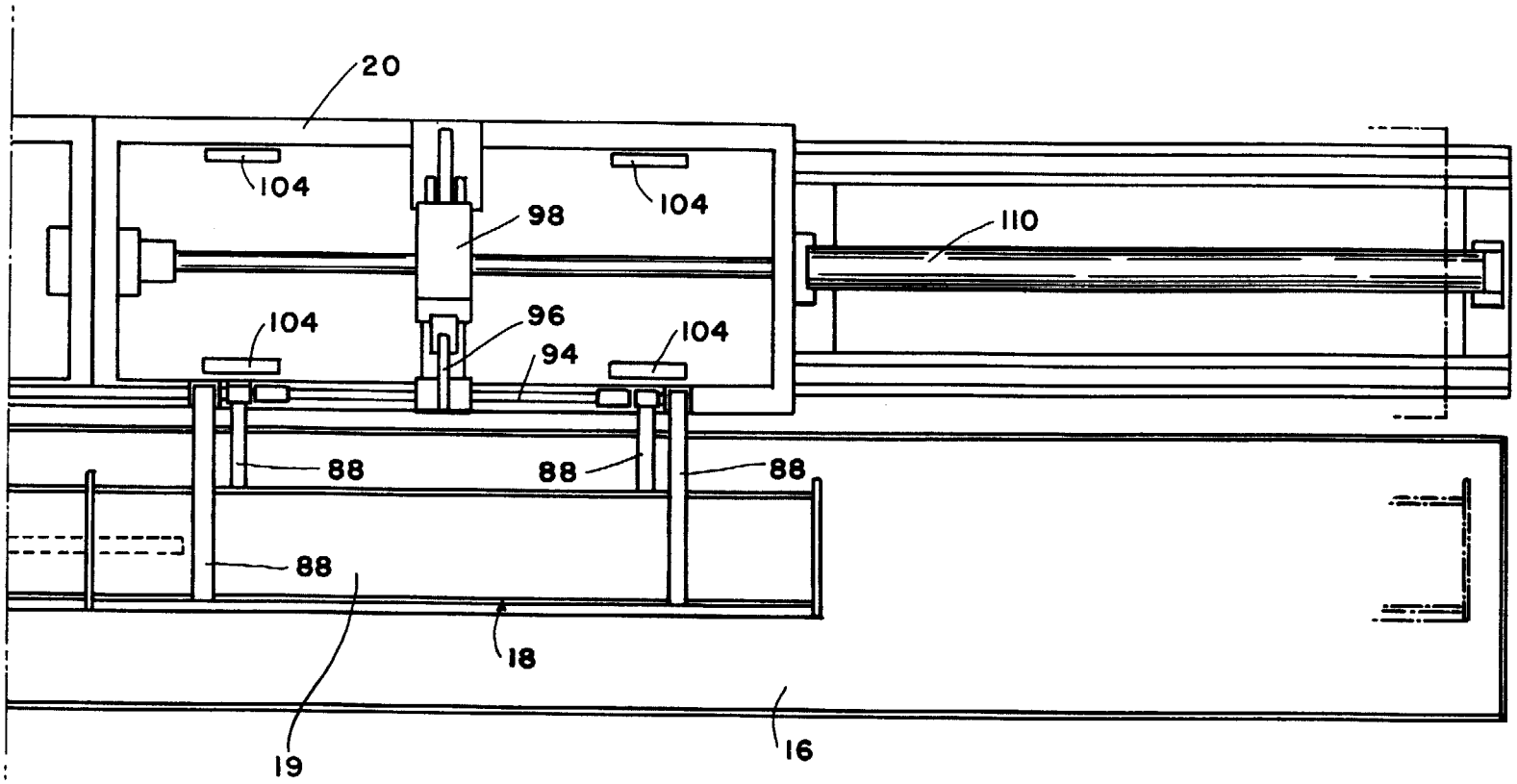

With reference to FIGS. 1A and 1B there is shown a portion of a press platen 10 through which an extrusion E passes into an opening 12 from a die arranged to the left of the platen, not shown. Into the opening 12 there is mounted the entry end of a cooling tube 14 which it will be noted extends entirely through the platen 10 at its one end and into a water tank 16 at its other end. An extrusion E shown in outline form is supported and transferred from the cooling tube 14 to the cooling tank 16 by a runout table 18 which is advanced axially of the path of travel of the extrusion by a carriage 20, FIG. 1B showing in phantom at its right extremity the extreme right hand portion of the table and carriage. A more detailed description of the cooling tube, runout table and carriage will be given with reference to the remainder of the drawings.

Figure 2A:
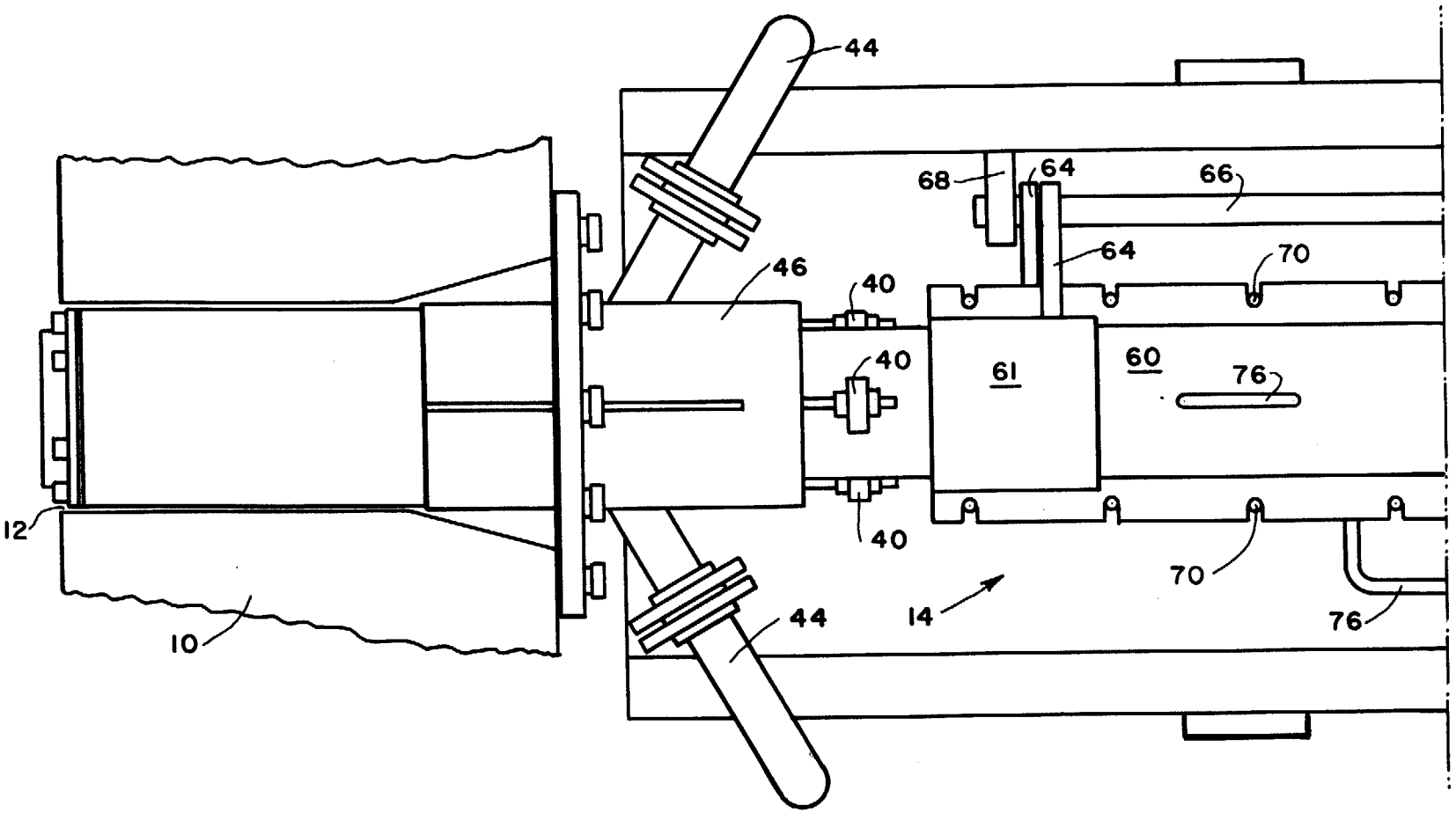
FIGS. 2A and 2B are continuation plan views in enlarged form of the cooling tube arrangement shown in FIGS. 1A and 1B.
Figure 2B:
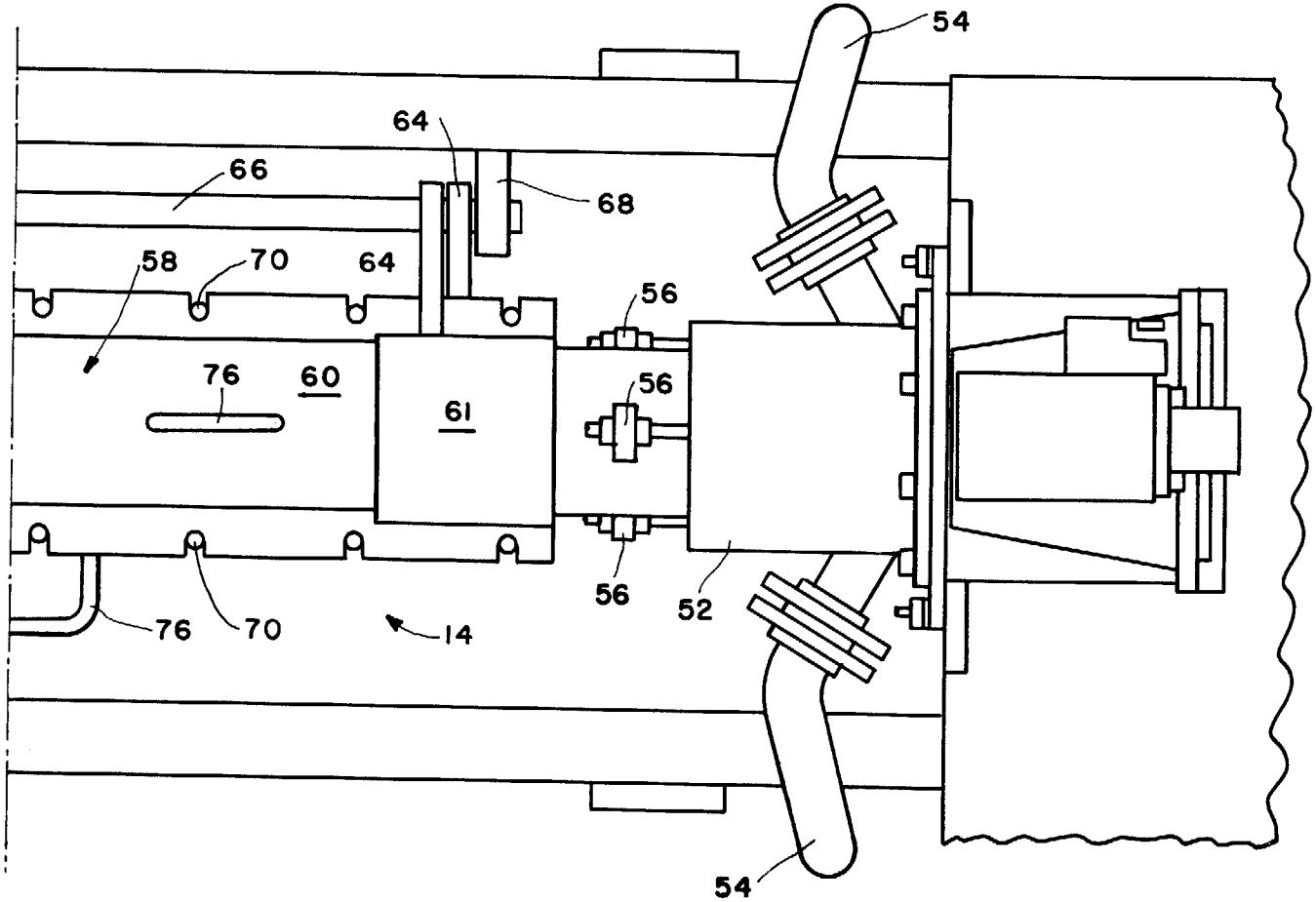
Figure 3A:
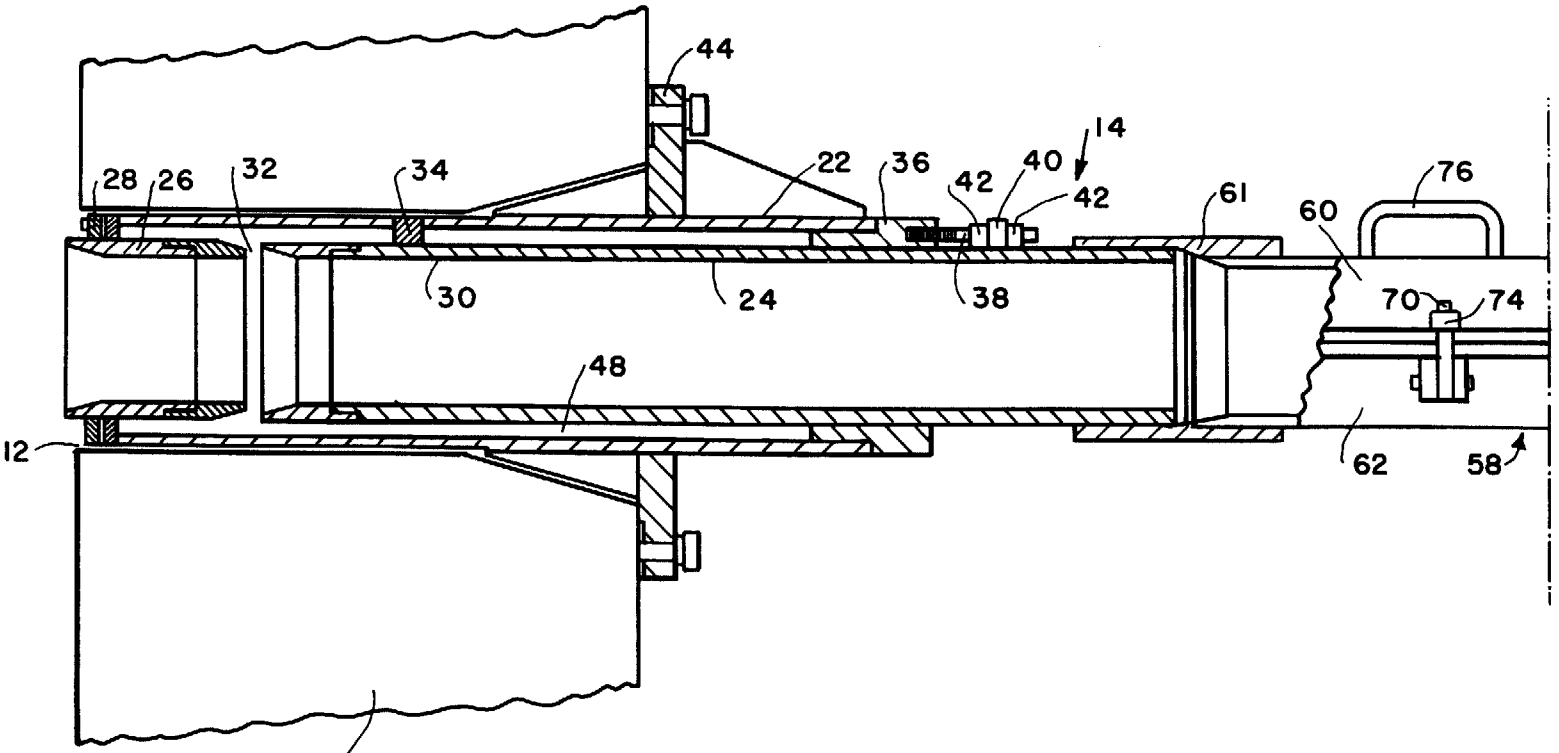
FIGS. 3A and 3B are continuation partial sectional views of the cooling tube shown in FIGS. 2A and 2B.

Referring now to FIGS. 2A-B, and 3A-B, there is shown in further detail the construction of the cooling tube 14. FIG. 3A illustrates that the press end of the cooling tube extends into and through the platen and that in this area it is made up in the form of an outer stationary member 22 and an inner tubular member 24. A first section of tube member 24 takes the form of a stationary section 26 mounted to the outer member 22 by a supporting and sealing collar 28. Between the inner end of the member 26 and the adjacent part of the tubular member 24, is a second section 30, the two sections 26 and 30 having a separation or gap that forms a nozzle 32. The section 30 is supported by the outer stationary member 22 by space collar members 34 and 36, the member 36 being also a sealing member and at its outer portion receives several threaded rods 38 each having a lug 40 and with respect to each lug, two nuts 42 are arranged on each side of the lug. The entire assembly as shown in FIG. 3A is carried by the platen 10 by a bolted plate 44.

The section 30 is adjusted axially of its axis to adjust the opening of the nozzle 32 and hence the quantity of water by simply loosening all the nuts 42 on one side of the lugs 40 and jacking the section either to the left or the right with the nuts 42 all on the other side of the lugs 40. After this all nuts are tightened to maintain the adjusted nozzle position. In FIG. 3A the section 30 is shown in its extreme right hand position so that the nozzle 32 is shown in its maximum open position.

The cooling medium, in this case water, as best indicated in FIG. 2A is delivered to the nozzle 32 and hence to the interior of the cooling tube 14 for cooling the extrusion by two diametrically located pipes 44 having their delivery ends mounted in a receiving collar 46. FIG. 3A shows the interior passageway 48 of the collar 46 where it can be observed that the water from the passageway 48 enters the inside of the cooling tube 14 very close to the die side of the platen 10.

Figure 3B:
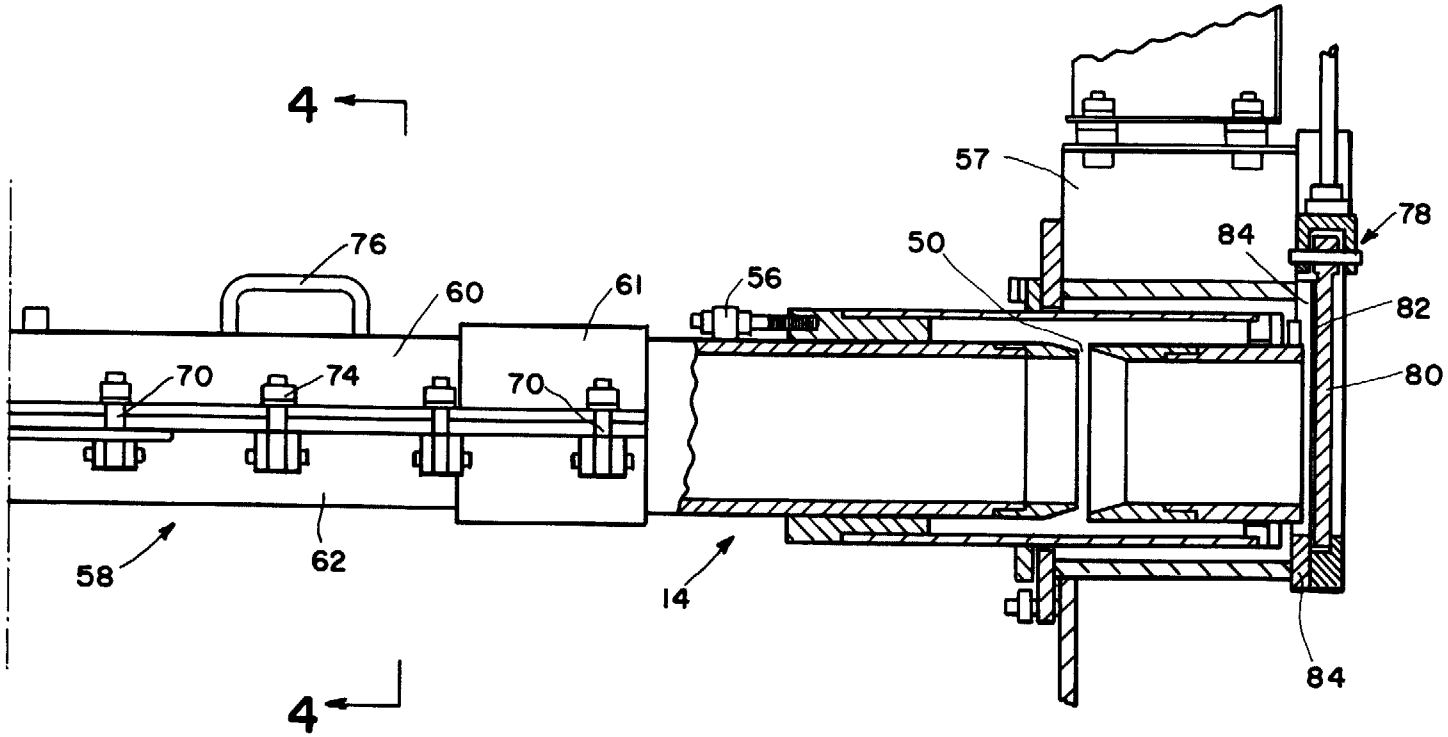

Referring now to FIGS. 2B and 3B, which pertain to the other end of the cooling tube 14, a second nozzle 50 is shown arranged closely adjacent to the entry end of the water tank 16 as best seen in FIG. 1A. Since this nozzle arrangement is constructed very similar to the nozzle arrangement 32, a description of the elements that make up the arrangement for the nozzle 50 will not be given. Suffice is to note in FIG. 2B the collar 52 and delivery pipes 54 that bring water to the nozzle 50 and the adjustable mechanism 56. This end of the cooling tube 14 is carried by a support 57 which forms part of the water tank 16. The nozzle 50 has three functions: one it augments the cooling of nozzle 32. It also prevents water from the tank from flowing back through the tube 14. It will be noted the cooling tube 14 is open at its press end and the water from the tank would otherwise flow back through the tube and come into contact with the hot extrusion tooling such as the die and container. Thirdly, the nozzle 50 is employed to empty the tube of water when the center section of the tube is to be opened.

Figure 4:
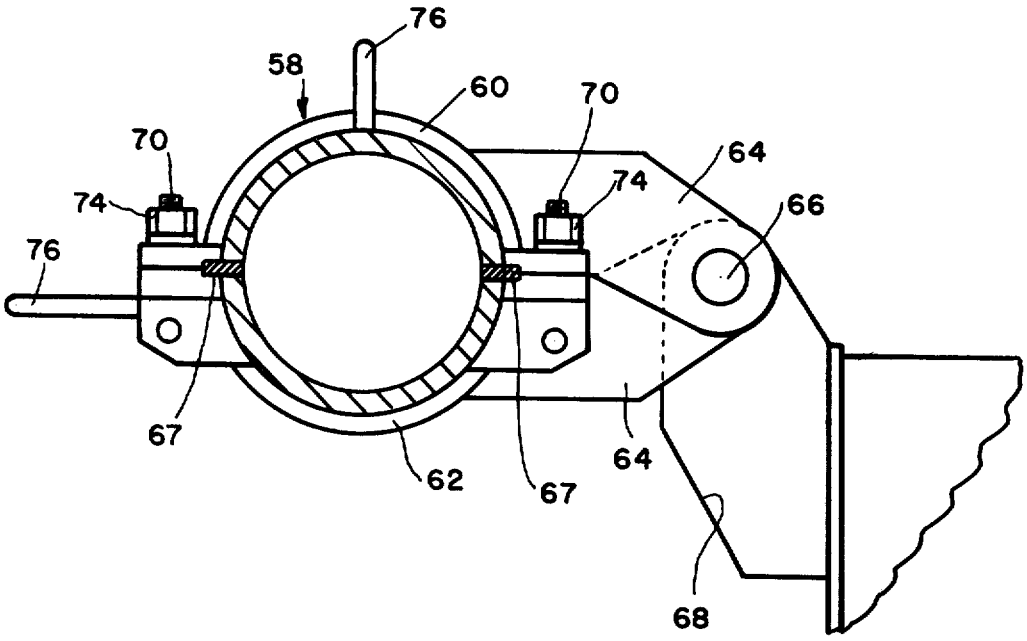
FIG. 4 is a sectional view taken on lines 4—4 of FIG. 3B.

One of the features of the present invention is the construction of the intermediate section of the cooling tube 14 which allows the quick removal of a cobbled extrusion from the cooling tube 14. FIGS. 2A and 2B and FIGS. 3A and 3B again best show this along with FIG. 4. The center section 58 of the cooling tube 14 is made up of two-half cylindrical members, more particularly a top member 60 and a bottom member 62. As shown in FIG. 4 the members 60 and 62 are at their inner sides provided with brackets 64 which are pivotally mounted on a common pin 66 to a stand 68. This construction allows the two members 60 and 62 to be completely removable from their positions around an extrusion. This is further facilitated by the members 60 and 62 being connected together with a number of swing bolts 70 on their opposite sides which as shown in FIGS. 3A and 3B are pivotally secured to the bottom member 62 and which in their holding position extend into slots formed in the upper member 60 where nuts 74 are employed to secure the members 60 and 62 together on both sides as one views FIGS. 2A and 3A. Gaskets 67 minimizes water leakage between the upper member 60 and the bottom member 62. To separate the members 60 and 62 the nuts are simply loosened a degree sufficient for them to be swung downwardly.

In referring to FIGS. 3A and 3B, there is shown as part of the center section 58 of the cooling tube 14, collar members 61 arranged on each end of the center section 58. These collars are also made in a 2-piece fashion similar to the members 60 and 62 to which they are welded. They are provided with similar swing bolts 70, and merely act as a coupling between the axially movable tube 24 and the swing members 60 and 62. A pair of handles 76 attached to each upper and lower members 60 and 62 are provided to allow the members to be moved from their operative to their inoperative positions.

Turning now to the gate arrangement provided between the water tank end of the cooling tube 14, and the water tank 16, reference will be made to FIGS. 1A and 3B. It must be appreciated that normally the level of the water in the tank 16 is maintained above the horizontal centerline of the cooling tube 14 so that unless prevented, water from the tank 16 will flow into the cooling tube and hence on to the hot extrusion tooling during the normal operation of the press. This also will occur during the period of time when the press is not operating. To eliminate the loss of water from the tank when the press is not operating, a gate mechanism 78 is provided between tank 16 and the cooling tube 14. The gate comprises a vertically arranged member 80 which is of sufficient dimensions to exceed the diameter of the delivery end of the cooling tube and which has on its cooling tube side a sealing gasket 82 that assumes a sealing relationship with a backup plate 84 mounted on the support 57 for the cooling tube 14. The member 80, shown in FIG. 3B in its sealing position, is lowered and raised by a piston cylinder assembly 86 shown in FIG. 1A.

Turning now to the runout table 18 and its carriage 20, reference will be made to FIGS. 1A, 1B and 5. It will first be noted in FIGS. 1A and 1B that the length of the runout table 18 is less than the corresponding length of the tank 16 by approximately the length of the cooling tube 14. In other words, the runout table 18 is designed to be advanced in a direction away from the cooling tube a distance sufficient to remove to the tank 16 the portion of the extrusion in the cooling tube 14. The runout table 18 has an upper and lower longitudinal portion 19.

Figure 5:
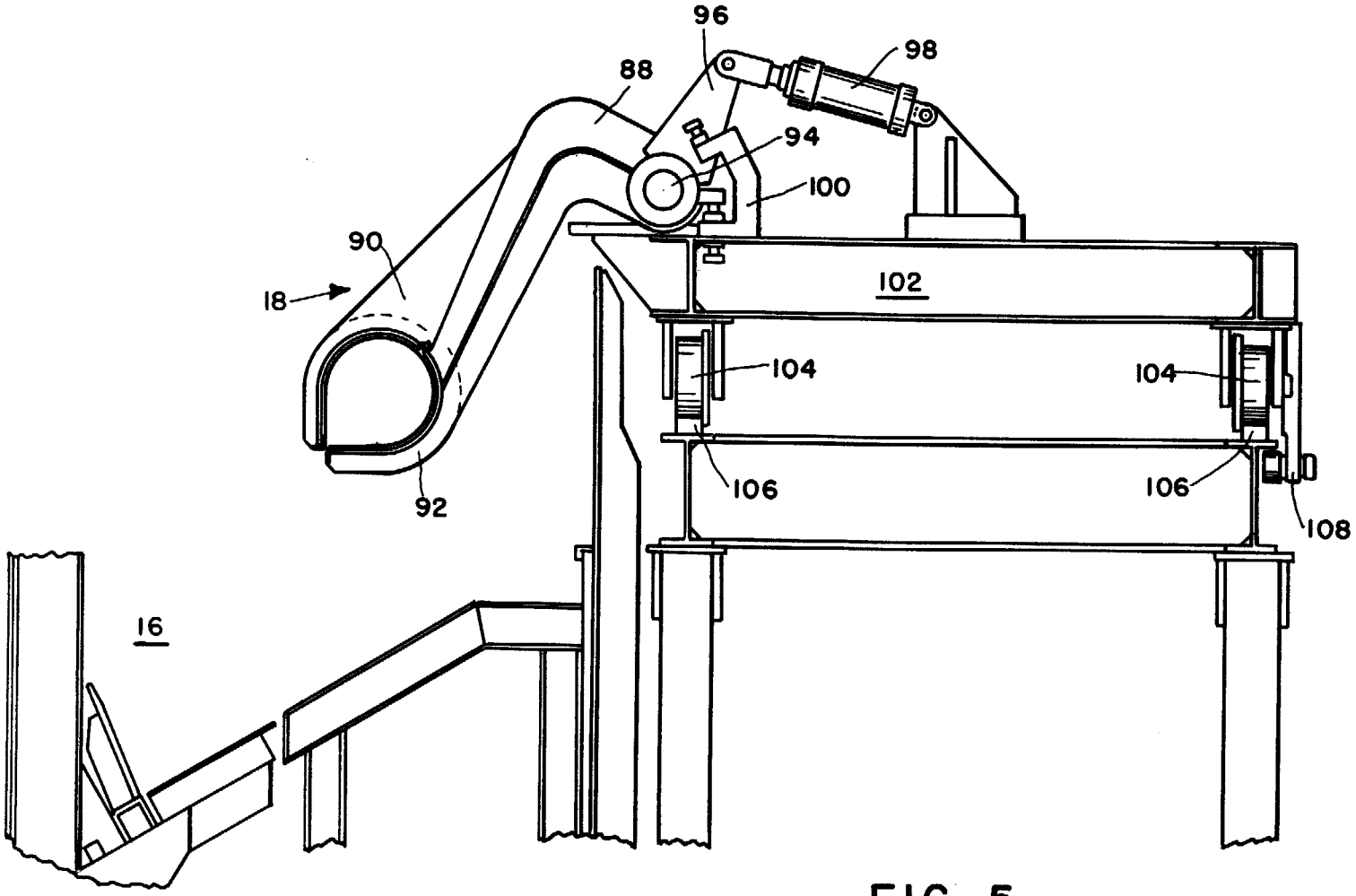
FIG. 5 is an enlarged elevational view of the runout table mechanism shown in FIGS. 1A and 1B.

FIG. 5 illustrates that the runout table 18 includes several sets of spaced apart arms 88. Each set of arms 88 in turn is made up of an upper member 90 to which the upper portion 19 of the runout table 18 is attached, and a lower member 92 to which the lower portion of the runout table 18 is attached. The lower member is mounted on a pivot shaft 94 and connected by brackets 96 to piston cylinder assemblies 98 which rotate the lower member 92 away from the upper member 90 to allow an extrusion to fall to the bottom of the tank 16. When in the position shown in FIG. 5 the arms, and particularly the members 92 thereof, are coaxially aligned with the cooling tube 14 so that the extrusion is maintained under water from the time it enters the platen 10. Any adjustment that should be necessary for the members 92, as well as a control of their movement is supplied by an adjusting stop mechanism 100 shown in FIG. 5. Aside from the lower portion of the sets of arms 88 of the runout table 18, the rest of its mechanism is arranged outside the tank 16 and more importantly, outside of the water. FIG. 5 illustrates that the shaft 94 and the piston cylinder assembly 98 are carried by a support beam 102 of the carriage 20. This beam is in turn carried by a number of freely rotatable wheels 104 that run on rails 106, being properly maintained by several guiding mechanisms 108. As shown in FIG. 1B, the carriage and hence the runout table 18 are advanced toward and away from the cooling tube by a piston cylinder assembly 110.

Referring again to FIG. 1A, and to the portion thereof illustrating the water system for the nozzles 32 and 50, there is shown lead in lines 112 for each collar 46 for their respective nozzles. These lines are served by separately controlled pumps 114 having motors 116 which are controlled by starters 118 and which in turn are controlled from an operator's pulpit. The pumps 114 receive their cooling medium, i.e., water, from lines 122 which run to the water tank 16, hence the water system is a closed loop system in which the water from the pump 114 run from the cooling tube 14 to the tank 16 and hence back to the pump 114. Because of the different requirements of the nozzles 32 and 50, the pump and motors for the nozzle 32 is designed to deliver a greater pressure of water than the pump and motor for the nozzle 50. The primary function of the nozzle 32 is to rapidly cool the hot extrusion as soon as it leaves the die and for this reason according to the invention it is mounted in the platen 10 close to the die. In order to obtain the required cooling rate the cooling medium delivered by the nozzle must be sufficiently high in intensity and volume to continuously penetrate the steam that will be created when the hot extrusion first contacts the water. The requirements for the nozzle 50 are not as demanding. Its intensity and volume need only be sufficient in the case when the press is operating, to supply additional cooling and hold back the water from the cooling tank 16 flowing into the cooling tube 14, thereby protecting the hot tooling from the tank water; and in the second case, where there is a cobbled extrusion, to draw the water from the cooling tube into the tank.

In briefly describing the process aspects of the present invention, assuming that the water system for the cooling tube 14 and the water tank 16 are operating to receive extrusions, the extrusion will be subjected to cooling as soon as it enters the platen immediately after leaving the die, and thereafter passes under water and is subjected to the nozzle 50 until it reaches the cooling tank 16. This will assure the optimizing of the benefits of rapid and controlled cooling after extrusion. This is accomplished primarily by the nozzle 32 due to its location and high intensity and volume and also by the nozzle 50 which operates also to prevent water from tank 16 flowing into the cooling tube 14, thereby protecting the tooling. It will be appreciated that during operation of the press the extrusion is completely under water from the time it enters the platen 10 and remains so until it leaves the cooling tank 16.

In the event of an occurrence of a cobbled extrusion in the cooling tube 14, where it is not possible to lower the gate mechanism 78, in addition to quickly removing the water from the cooling tube and to prevent water from running from the tank into the tube, which it would otherwise do, due to the difference in elevation of the water level in the tank, the first nozzle 32 is shut down while the nozzle 50 continues to operate. The construction, arrangement, pressure and volume of water issuing from the nozzle 50 is designed to both remove the water from the cooling tube 14 and force it into the tank 16 and at the same time prevent the water in the tank from flowing into the cooling tube. Once the water has been emptied from the tube in this manner, which can be accomplished very quickly, the center section 58 of the cooling tube can be quickly separated and the exposed portion of the extrusion quickly removed which may involve cutting one or more sections of the extrusion.

When the press is not operating and it is desired not to lose water from the tank 16 by it running to the cooling tube 14, the gate mechanism 78 is lowered to seal the water from flowing from the tank into the tube.

In accordance with the provisions of the patent statutes, we have explained the principle and operation of our invention and have illustrated and described what we consider to represent the best embodiment thereof.

We claim:

1. In a method of cooling a hot extrusion by passing it below the level of a cooling medium immediately after extruded by an extrusion press, having a platen through which the extrusion passes, by employing in cooperative spaced relationship, a cooling tube and a cooling tank, and for quickly emptying and refilling the cooling tube on the experience of certain operational conditions, the steps of:

arranging a cooling tube below the surface level of cooling medium in the cooling tank, which cooling tube has a portion inside said platen to receive an extrusion produced from a die and a portion outside said platen having at least a two-piece member arranged between said platen and said cooling tank into which the extrusion is delivered from said cooling tube, applying a first source of cooling medium into said tube in a manner that the extrusion is cooled while passing through said platen, causing said cooling tube to subject the extrusion to cooling from the time it enters said platen until its delivery to said cooling tank, applying a second source of cooling medium to the extrusion when in said cooling tube after cooling by said first source takes place and before the extrusion enters into said tank, causing said second source of cooling medium to direct its cooling medium in the direction of travel of said extrusion passing through said cooling tube, on the experience of said operational conditions, discontinuing said application of said first source of cooling medium, and at the same time, continuing said application of said second source of cooling medium to draw the cooling medium out of said tube and to prevent cooling medium from said tank from passing into said cooling tube, and separating said two members to expose at least a portion of said extrusion extending between said platen and said cooling tank for quick removal of said extrusion portion.

2. In a method according to claim 1 the further steps of:

maintaining the pressure and/or volume of cooling medium from said first cooling source sufficient to rapidly cool the hot extrusion immediately after leaving said die and maintaining the pressure and/or volume of cooling medium from said second cooling source sufficient to prevent water from flowing from said cooling tank into the cooling tube.

3. In a method according to claim 1 the further step of physically interrupting the flow of cooling medium from said cooling tank into said cooling tube when no extrusion extends between said cooling tube and tank.

4. In combination with a hot extrusion press having a platen through which a hot extrusion passes, a cooling tank, and a cooling tube arranged between said platen and said tank, the tank and tube being employed to cool a hot extrusion by a cooling medium:

means for mounting a portion of said cooling tube, which is located below the surface level of the cooling medium in said cooling tank, inside said platen in a manner to receive an extrusion produced from a die, said cooling tube including a portion inside said platen to receive an extrusion produced from a die and a portion outside said platen having at least a two-piece member arranged between said platen and said cooling tank into which the extrusion is delivered from said cooling tube, first means for delivering cooling medium to said cooling tube within said platen in a manner that the extrusion is cooled while passing through said platen, second means for delivering cooling medium within said cooling tube downstream from said first means for delivering cooling medium adjacent said cooling tank to additionally cool said extrusion before it enters said tank, said second means including means constructed and arranged to direct said cooling medium in the direction of travel of said extrusion passing through said cooling tube, means, where operational conditions warrant such, for operating said first means to discontinue said delivery of said cooling medium from said first means and for continuing the operation of said second means to draw said cooling medium out of said cooling tube and to prevent said cooling medium from said tank from passing into said tube, and means for connecting said two-piece member together in a manner that upon said condition said pieces can be quickly separated from each other to expose at least a portion of said extrusion extending between said platen and said cooling tank for quick removal of said extrusion portion.

5. In combination with a hot extrusion press according to claim 4, means for maintaining the pressure and/or volume of cooling medium from said first cooling source sufficient to rapidly cool the hot extrusion immediately after leaving said die and maintaining the pressure and/or volume of cooling medium from said second source sufficient to prevent water from flowing from said cooling tank into said cooling tube.

6. In combination with a hot extrusion press according to claim 4, means for physically preventing the flow of cooling medium from said cooling tank into said cooling tube when no extrusion extends between said cooling tube and tank.

7. In combination with a hot extrusion press according to claim 4, wherein said means for delivering said source of cooling medium to said cooling tube comprises a tubular member for receiving said extrusion and retaining said cooling medium, means for supporting said tubular member in a manner that permits relative movement between said supporting means and said tubular member, and means for causing said relative movement in a manner to adjust the quantity of cooling medium delivered to said extrusion without disturbing the operating function of said cooling tube.

8. In combination with a hot extrusion press according to claim 7 wherein said supporting means comprises an outer tubular arrangement having a stationary member, said means for causing said relative movement connected to said stationary member and being constructed and arranged to effect axial movement of said cooling tube relative to said supporting means.

9. In combination with a hot extrusion press according to claim 4 wherein each member of said two-piece member includes spaced arm means, common pivotal support means for said arm means and wherein said connecting means includes swingable fastening means constructed and arranged to quickly disconnect said multi-piece member and allow each member thereof to be pivoted away to a position exposing an extrusion in said cooling tube.

10. In combination with a hot extrusion press according to claim 4, wherein said cooling tank further includes a runout table means for receiving and supporting an extrusion issuing from said cooling tube, said tank being constructed and arranged so that the extrusion is completely submerged in coolant while in the tank, said runout table means having a first portion extending from alongside one side of said tank outside said coolant and a second portion operatively connected to said first portion submerged in said coolant for receiving and supporting an extrusion issuing from said cooling tube, support means for said first portion, carriage means, means for mounting said support means on said carriage means, guiding and advancing means for said carriage means constructed and arranged to allow said carriage means to travel along said one side of said tank and coaxially with the path of the extrusion delivered to said tank.

11. In combination with a hot extrusion press, according to claim 10 wherein said runout table means includes sets of cooperative arms, each set of cooperative arms having at their lower ends extrusion supporting elements, one element assuming a lower operative extrusion supporting position, and the other element assuming an upper operative extrusion supporting position, and means for moving said lower elements away from their cooperative upper elements to allow an extrusion to fall to the bottom of said cooling tank.

* * * * *